US007017643B2

(12) United States Patent
Leum

(10) Patent No.: US 7,017,643 B2
(45) Date of Patent: Mar. 28, 2006

(54) GUARD ASSEMBLY AND HANDRAIL FOR USE WITH OVERHEAD DOORS

(76) Inventor: Grant Leum, S.95 W.13159 Walter Hagan Ct., Muskego, WI (US) 53150

( * ) Notice: Subject to any disclaimer, the term of this patent is extended or adjusted under 35 U.S.C. 154(b) by 17 days.

(21) Appl. No.: 10/444,430

(22) Filed: May 23, 2003

(65) Prior Publication Data

US 2004/0231806 A1 Nov. 25, 2004

(51) Int. Cl.
*E06B 3/48* (2006.01)

(52) U.S. Cl. ..... 160/113; 160/201; 160/229.1; 49/97

(58) Field of Classification Search ..... 160/113, 160/114, 191, 229.1, 201, 352; 49/97, 95
See application file for complete search history.

(56) References Cited

U.S. PATENT DOCUMENTS

| | | | | | |
|---|---|---|---|---|---|
| 1,928,819 | A | * | 10/1933 | Neller | 119/524 |
| 2,128,139 | A | * | 8/1938 | Gorar | 49/126 |
| 2,585,152 | A | * | 2/1952 | Merchant | 49/160 |
| 3,740,022 | A | * | 6/1973 | DiGiovanni | 256/24 |
| 3,825,095 | A | * | 7/1974 | Clark | 182/17 |
| 4,122,631 | A | * | 10/1978 | Batcheller | 49/394 |
| 4,356,668 | A | * | 11/1982 | Wagner | 49/506 |
| 4,422,264 | A | * | 12/1983 | Harris | 49/121 |
| 4,493,164 | A | | 1/1985 | Wagner | |
| 4,986,389 | A | | 1/1991 | Halligan, Sr. et al. | |
| 5,101,595 | A | * | 4/1992 | Rhoades | 49/28 |
| 5,271,183 | A | | 12/1993 | Hahn et al. | |
| 5,299,386 | A | | 4/1994 | Naegelli et al. | |
| 5,408,789 | A | * | 4/1995 | Plfeger | 52/173.2 |
| 5,459,963 | A | | 10/1995 | Alexander | |
| 5,564,238 | A | * | 10/1996 | Ellis | 52/173.2 |
| 5,628,149 | A | * | 5/1997 | Kraczek | 49/396 |
| 5,649,396 | A | | 7/1997 | Carr | |
| 6,092,580 | A | | 7/2000 | Lucas | |
| 6,192,629 | B1 | * | 2/2001 | Akins et al. | 49/382 |
| 6,212,826 | B1 | * | 4/2001 | Kimener | 49/97 |
| 6,279,276 | B1 | | 8/2001 | Knoll | |
| 6,427,632 | B1 | * | 8/2002 | Horst et al. | 119/518 |
| 2003/0199996 | A1 | * | 10/2003 | Reynard et al. | 700/17 |

FOREIGN PATENT DOCUMENTS

| | | | | |
|---|---|---|---|---|
| JP | 166382 | * | 6/1999 | 160/113 X |

* cited by examiner

*Primary Examiner*—Bruce A. Lev
(74) *Attorney, Agent, or Firm*—Jansson, Shupe, Munger & Antaramian, Ltd.

(57) ABSTRACT

A guard assembly is used near a doorway with an overhead door on a platform having at least one post mounted adjacent the doorway. The assembly preferably comprises a barrier adapted to extend across the doorway and having at least one coupling which is adapted to connect to a respective post to allow the barrier to block the doorway; and a bracket adapted to facilitate connection and disconnection between the barrier and the overhead door. Such an assembly allows the barrier to block the doorway whether connected to or disconnected from the door and to move with the door as the door opens and closes.

23 Claims, 10 Drawing Sheets

GUARD ASSEMBLY AND HANDRAIL FOR USE WITH OVERHEAD DOORS

FIELD OF THE INVENTION

The invention relates to the field of overhead doors, and, more particularly, to overhead doors used on raised loading docks.

BACKGROUND OF THE INVENTION

Typically loading docks include a raised dock for the loading and unloading of materials which often come in large quantities and are carried by wooden pallets. Most docks have doorways with overhead doors that provide access to a garage or similar type of building. These overhead doors are similar to garage doors found in most domestic homes and may be operated manually or automatically.

In many cases, a dock leveler is mounted in a pit in the loading dock in front of the doorway and operation of the dock leveler will serve to bridge the gap between the loading dock and a truck parked in front of the dock so that personnel and material handling equipment, such as a forklift truck, can conveniently move between the loading dock and the truck bed.

During a loading operation the truck body will enclose the open doorway in the dock. Often when a loading dock operation is not taking place, it is desired to maintain the overhead door in an open position to provide increased ventilation or light in the building or to vent smoke, fumes or odors from the building.

While there are typically a pair of posts mounted on opposite sides of the doorway to provide a barricade that will protect a forklift truck from damaging the wall or door track at one or both sides of the door, there is a possibility that a forklift truck maneuvering on the dock may accidentally back through the open doorway and fall off the loading dock to the driveway, thus causing possible injury to personnel and/or damage to equipment.

Attempts to prevent such damage have heretofore included the use of a second door mounted inside of the outer door and constructed of metal mesh to allow the passage of light and air. However, such additional security doors have required use of an additional overhead track system and prohibit passage of materials and people.

Other attempts have including placing barriers in front of the doorway. However, such barriers must typically be moved by an operator and then must be stored in an non-traffic area.

Thus, there is a need in the field for a loading dock guard assembly which is readily installed on pre-existing doors and does not require additional tracks, motors or separate operation from the overhead door.

In addition, there is a need for a loading dock guard assembly which allows passage of people or things, such as packages, while preventing passage of vehicles.

Also, there is a need for a loading dock guard assembly which may be moved into and out of blocking position by an overhead door, and be disconnected from such door to remain in blocking position while the door is open or closed.

A guard assembly for use with overhead doors platforms which addresses the problems of known devices would be an important advance in the art.

OBJECTS OF THE INVENTION

It is an object of the invention to provide a guard assembly for use with an overhead door which can be installed on existing doors.

Another object of the invention is to provide a guard assembly for use with an overhead door which includes a barrier that can be connected to an overhead door to be raised into an open position and lowered into a blocking position.

Another object of the invention is to provide a guard assembly for use with an overhead door which includes a barrier that can be disconnected from a door to block the doorway while the door is opened.

Another object of the invention is to provide a guard assembly for use with an overhead door which includes a barrier that connects to at least one post located adjacent the doorway to block the doorway.

Another object of the invention is to provide a guard assembly for use with an overhead door which includes a guard rail and, most preferably, an OSHA compliant hand rail.

Another object of the invention is to provide a guard assembly for use with an overhead door which includes a barrier pivotably connected to the door to allow movement with the door to an open position.

Another object of the invention is to provide a guard assembly for use with an overhead door to block a vehicle from driving off of a dock when the door is open.

Yet another object of the invention is to provide a guard assembly for use with an overhead door which includes barrier means adapted to block the doorway when disconnected from the door whether open or closed; block the doorway when connected to the door while the door is closed; and, when connected to the door, move with the door as the door opens so that the barrier means does not block the doorway.

Still another object of the invention is to provide an efficient and economical way to block an overhead door doorway with a movable barrier.

How these and other objects are accomplished will become apparent from the following descriptions and drawings herein.

SUMMARY OF THE INVENTION

This invention is a guard assembly for use near a doorway on a platform. The invention represents a significant advance over the state of the art by providing novel elements to provide broader use, retrofit capability, and safety to loading docks with overhead doors.

The guard assembly comprises: a barrier adapted to extend across and block the doorway, the barrier having at least one coupling adapted to connect to a respective post and to be preferably supported by the post; and a bracket adapted to facilitate connection and disconnection between the barrier and the overhead door. Such an assembly allows the barrier to block the doorway whether connected to or disconnected from the door. In addition, the barrier, when connected to the door, is adapted to move with the door as the door opens and closes.

In certain preferred embodiments, the bracket is fixed to the barrier and is adapted for connection with and disconnection from the door. In these embodiments the bracket and door are preferably adapted for connection and disconnection by a pin. In other embodiments, the bracket is fixed to the door and is adapted for connection and disconnection from the barrier. In these embodiments the bracket and barrier are preferably adapted for connection and disconnection by a pin. Therefore, in most preferred embodiments, the bracket is fixed to one of the barrier and the door and is adapted for connection with and disconnection from the other of the barrier and the door, such connection and disconnection preferably being performed by a pin.

Connection and disconnection are preferably performed in "one motion," i.e., the door and bracket or barrier and bracket are automatically aligned and the operator simply needs to move the pin along an axis to connect or disconnect the bracket from the other object. "One-motion" connection/disconnection defines such an action in which the operator need only move the pin in the desired direction, no other actions are necessary to complete connection/disconnection since the guard assembly automatically positions the door, bracket and barrier into position for connection/disconnection after installation.

The platform preferably has two posts mounted on opposite sides of the doorway and the barrier preferably has two couplings which are each adapted to connect to a respective post. Each coupling is preferably a sleeve which is adapted to receive the respective post. In certain embodiments, the couplings are guard couplings and the assembly further comprises upper couplings which are also adapted to connect to respective posts.

The barrier may also include a guard rail extending between the couplings, a pair of uprights extending from the guard rail to distal ends, and a hand rail extending between the distal ends of the uprights. In certain variations of such embodiments, the bracket preferably includes first and second brackets with each bracket being pivotably connected to the barrier and connected to a respective upright by a tensioning element. In other variations of such embodiments, the bracket includes first and second brackets with each bracket being pivotably connected to the door and further connected to the door by a tensioning element.

In certain embodiments, the door is movable along a track and the barrier includes a guard rail, a pair of uprights extending from the guard rail to a distal end, and a hand rail extending between the distal ends of the uprights while the bracket includes first and second brackets which provide pivotable connection between the barrier and the door and, optionally, are connected to a respective upright or to the door by a tensioning element. In such embodiments, the distal ends of the uprights are adapted to contact a sloping portion of the track and cause both the barrier to pivot with respect to the door and the tensioning element to extend, thereby allowing the distal ends of the uprights to move substantially horizontally as the guard rail moves substantially vertically when the door and barrier are connected and the door opens. Each bracket preferably provides pivotable connection between the barrier and the door such that the barrier is adapted to pivot with respect to the door as the distal ends of the uprights move substantially horizontally and the guard rail moves substantially vertically.

In other embodiments, the guard assembly is intended for use with doors which run on tracks that do not include a sloping or substantially horizontal portion, i.e., they extend substantially vertically above the doorway. In such embodiments, the barrier need not be pivotable with respect to the door. Therefore, in such embodiments, the bracket is mounted to one of the door and barrier and is adapted for connection to the other of the door and barrier, with neither the mount nor the connection providing for pivotability.

In another description of the invention, the guard assembly for use near a doorway on a platform comprises: barrier means adapted to extend across the doorway and having at least one coupling means adapted to connect to a respective post; and connection means adapted to facilitate connection and disconnection between the barrier means and the overhead door. Thus, the barrier means is adapted to block the doorway when disconnected from the door, block the doorway when connected to the door while the door is closed, and move with the door when connected to the door as the door opens so that the barrier means does not block the doorway. When connected to the door, the barrier means is preferably adapted to move with the door as the door closes and to connect to the post to block the doorway.

The connection means is preferably pivotably mounted to one of the barrier means and the door, a bracket pivotably mounted with respect to one of the door and barrier means, and latching means adapted to connect to and disconnect from the other of the door and barrier means. In certain embodiments, the connection means may include a door plate mounted with respect to the door, a hinge plate pivotably connected to the barrier means and a latching means to connect the door plate and hinge plate. In certain other embodiments, the connection means may include a door plate mounted with respect to the door, a hinge plate pivotably connected to the door plate and a latching means to connect the hinge plate to the barrier means. In such embodiments, the barrier means preferably includes a receiving bracket for connection to the hinge plate.

In another description of the invention, the guard assembly, in combination with an overhead door in a doorway and a pair of posts mounted on opposite sides of the doorway, comprises: a barrier having two ends with a coupling at each end is adapted to extend across the doorway with each coupling adapted to connect to a respective post; and a bracket adapted to facilitate connection and disconnection between the barrier and the overhead door. In such an embodiment, the barrier is adapted to block the doorway whether connected to or disconnected from the door, and the barrier, when connected to the door, is adapted to move with the door as the door opens and closes.

In certain embodiments, each post includes a truss which joins the respective post at a shoulder which supports the couplings. It is preferred that the couplings be adapted to contact the respective shoulder when the door is closed and the bracket connects the door and barrier. In certain embodiments, the door preferably includes a plate and the couplings are adapted to contact the respective shoulder when the plate and bracket are aligned to allow a pin to pass therethrough to pivotably connect the door and the barrier.

In other certain embodiments, the barrier includes a guard rail extending between the couplings, a pair of uprights extending from the guard rail to a distal end, and a hand rail extending between the distal ends of the uprights; the bracket includes first and second brackets which are each pivotably connected to the barrier and connected to a respective upright by a tensioning element; and the overhead door includes pivotably connected panels and moves along a track having substantially vertical and substantially sloping portions. In such embodiments, the distal ends of the uprights are adapted to contact the substantially sloping portion of the track to cause the barrier to pivot with respect to the brackets and to cause the tensioning element to extend to allow the distal ends of the uprights to move substantially horizontally as the guard rail moves substantially vertically when the barrier is connected to the door as the door opens.

BRIEF DESCRIPTION OF THE DRAWINGS

The drawings illustrate preferred embodiments which include the above-noted characteristics and features of the invention. The invention will be readily understood from the descriptions and from the drawings, in which.

DETAILED DESCRIPTION OF PREFERRED EMBODIMENTS

Figure 1:
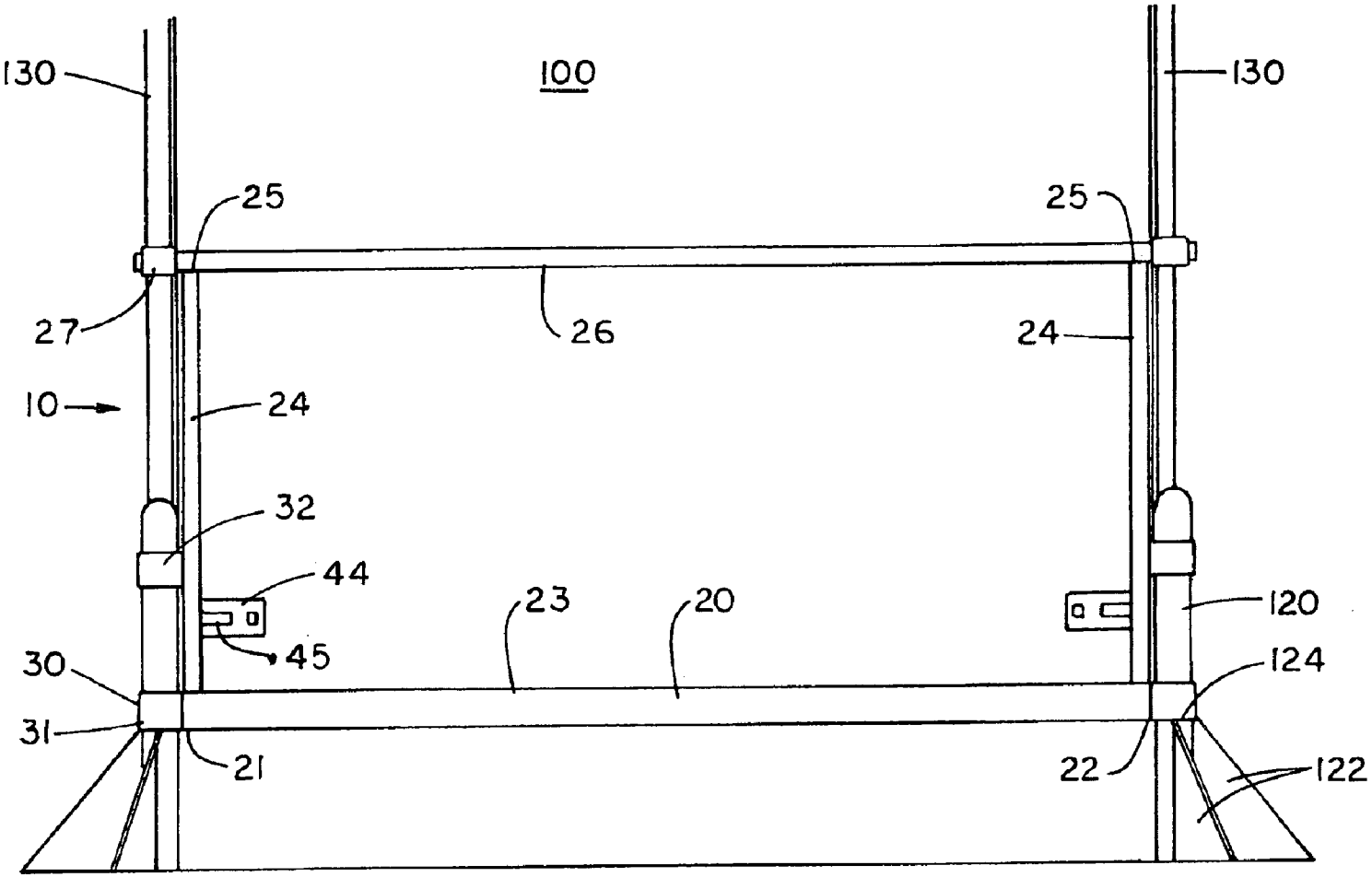
FIG. 1 is a front view of the guard assembly in accordance with the invention.
Figure 2:
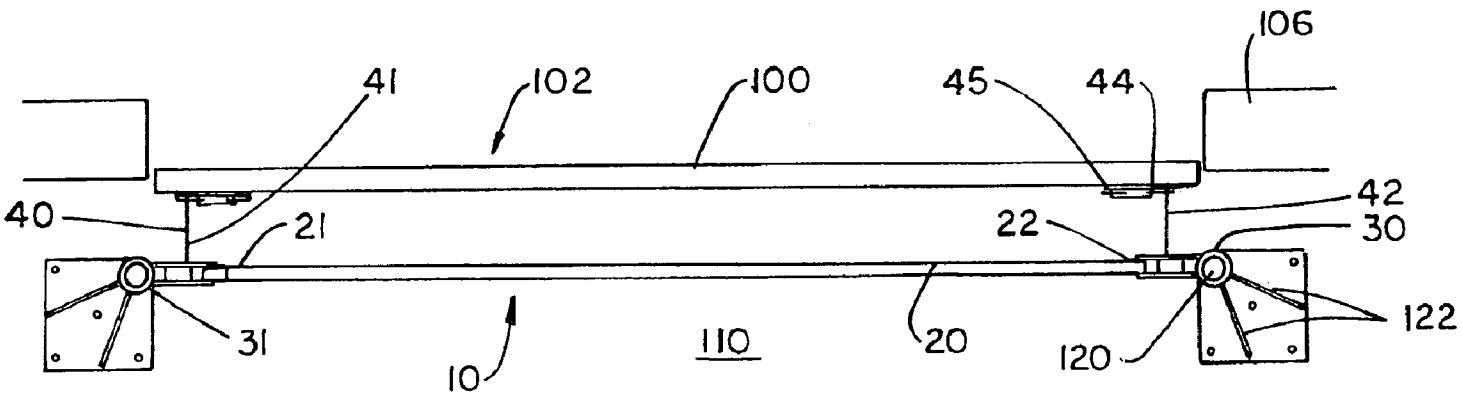
FIG. 2 overhead view of a barrier in connection with the posts and door in accordance with the invention.

Referring to FIGS. 1 and 2, details of the guard assembly 10 for use near a doorway 102 on a platform 110 will be set forth. The guard assembly 10 includes a barrier 20 which can be connected to a door 100 and coupled to at least one post 120 near the doorway 102. The posts 120 are preferably mounted to the platform 110 near doorway 102 and equidistant from wall 106 and may be supported by at least one truss 122. Trusses 122 preferably join the posts to form shoulders 124 which can support barrier 20 when barrier 20 and posts 120 are coupled.

Barrier 20 includes a guard rail 23 and preferably has couplings 30 at each end 21,22 to couple with posts 120. Couplings 30 are preferably sleeves which are formed to slide around posts 120 such that each post 120 is received within a coupling 30. In certain embodiments, uprights 24 extend substantially vertically from barrier 20 and a hand rail 26 preferably extends between the distal ends 25 of uprights 24. Also connected with respect to uprights 24 are upper couplings 32 which, like guard coupling 31, are sleeves which are dimensioned to receive posts 120 therein.

Hand rail 26 preferably includes a roller 27 at each end to contact track 130 to which door 100 is mounted. Hand rail 26 is preferably compliant with work environment requirements pertaining to railings such as OSHA 1910.23 which requires that certain types, sizes and arrangements of railing construction have a smooth-surfaced top rail at a height above floor, platform, runway or ramp level of 42 inches nominal, have a strength to withstand at least the minimum requirement of 200 pounds top rail pressure, and include protection between the top rail and the floor, platform, runway, ramp or stair treads equivalent to at least that afforded by a standard intermediate rail.

Figure 3:
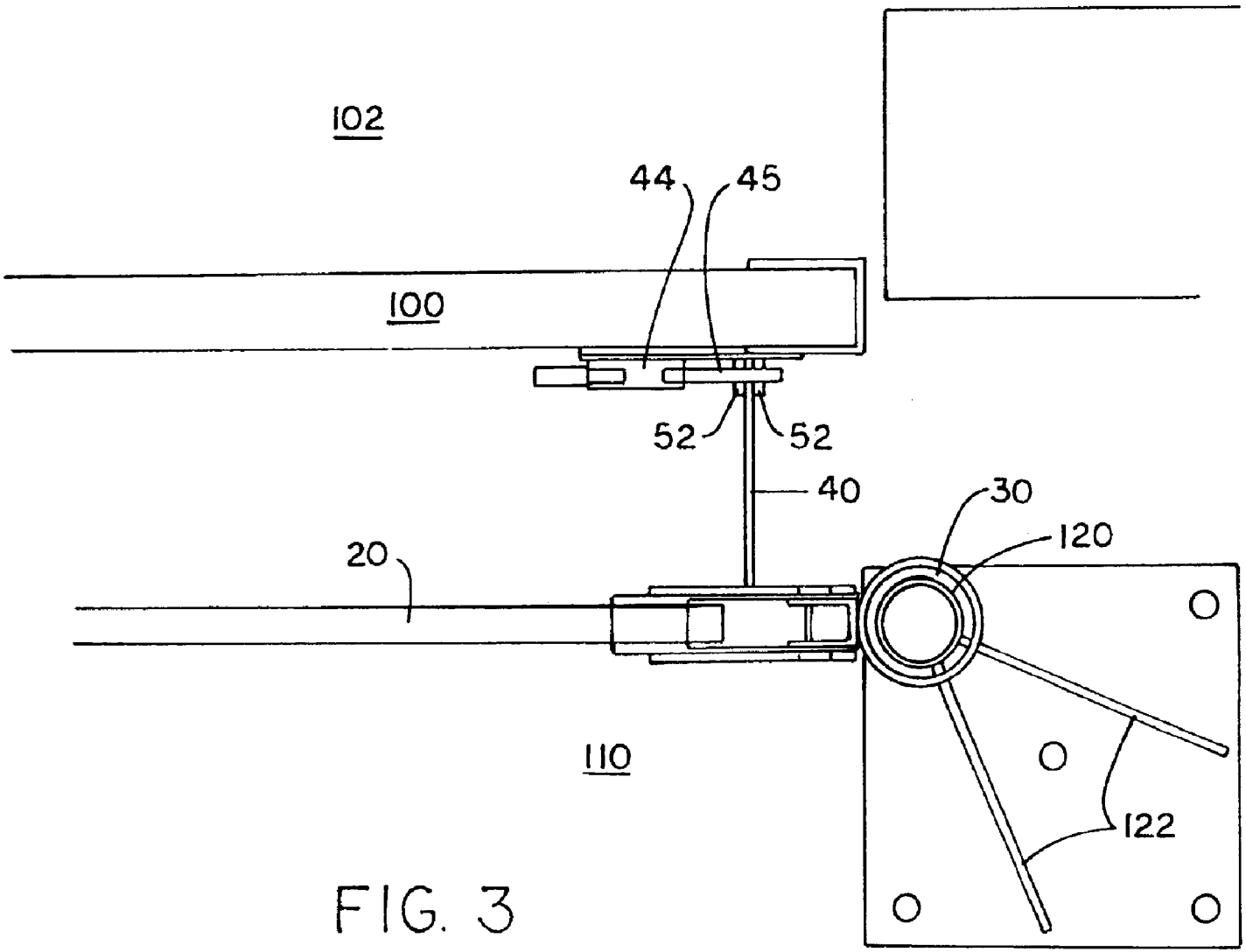
FIG. 3 is an enlarged view of the connection between the barrier and a post and the door in accordance with the invention.

Barrier 20 can be connected to door 100 through use of bracket 40. Preferably first and second brackets 41,42 interconnect door 100 and each end 21,22 of barrier 20. In order to facilitate connection and disconnection between barrier 20 and door 100, at least one door plate 44 is mounted on door 100. Each plate 44 includes a channel 55 which receives a pin 45. Channel 55 is preferably designed to align with a hole 56 in bracket 40 when door 100 is closed and barrier 20 is coupled to posts 120 and rests on shoulders 124. Pin 45 can then slide through hole 56 to connect barrier 20 and door 100. FIG. 3 offers an enlarged view of the right side of FIG. 2. As shown, pin 45 is in the locked position and passes through bracket 40 and raised walls 52.

Figure 5:
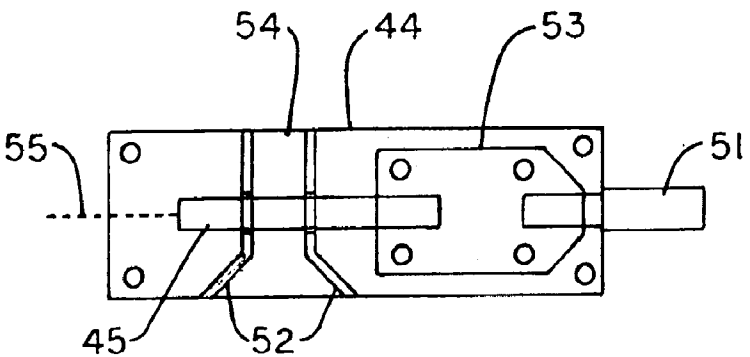
FIG. 5 is a plan view of a pin and preferred bracket components in accordance with the invention.

FIG. 5 shows door plate 44 in more detail. Plate 44 includes two raised walls 52 which form a groove 54 which is formed to snugly receive bracket 40. When hole 56 in bracket 40 is aligned with channel 55, pin 45 can be moved along channel 55 through hole 56 in bracket 40. Pin 45 is then engaged by raised walls 52 and bracket 40 and interconnects door 100 and barrier 20. This locked position is shown in FIG. 5. To facilitate movement of pin 45 into and out of the hole in bracket 40 there is provided handle 51 which is connected to pin 45 within housing 53. As is understood, handle 51 can be moved in a pivoting motion to cause pin 45 to slide along channel 55 into and out of groove 54.

Figure 4B:
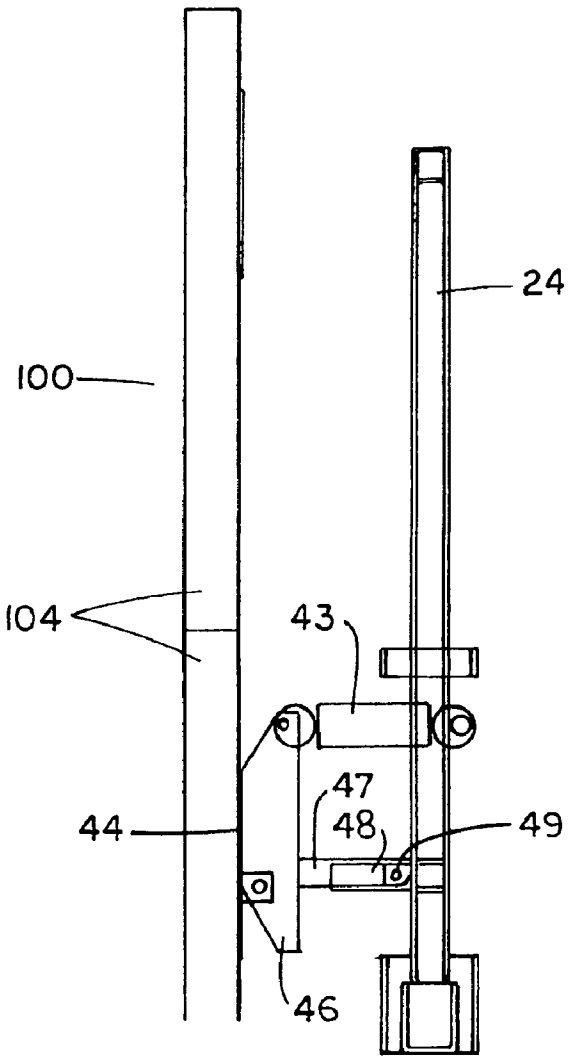
FIGS. 4*a* and 4*b* are side views of a preferred guard assembly shown disconnected and connected to a door in accordance with the invention.
Figure 4A:
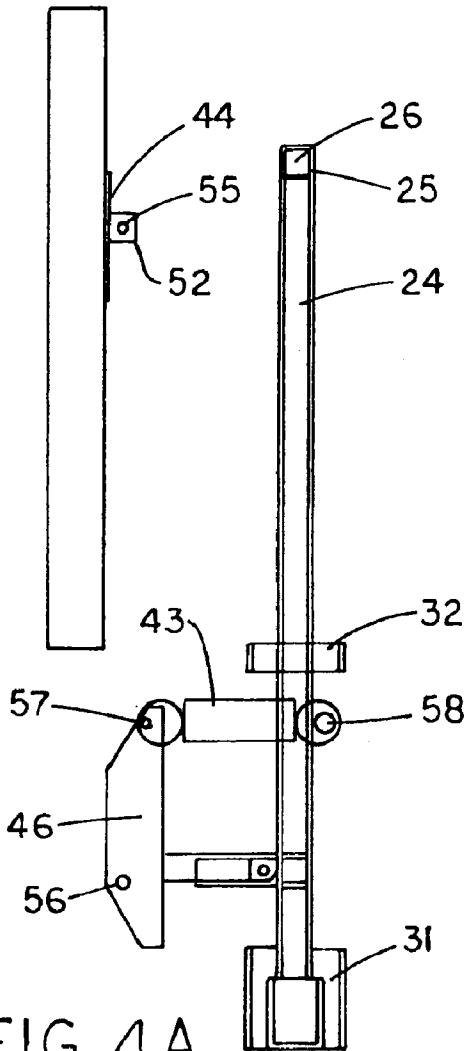

FIGS. 4*a* and 4*b* are side views of the barrier 20, bracket, 40 and door 100 and show the preferred version of door 100 as having pivotably connected door panels 104. As can be seen, door plate 44 includes channel 55 which is defined by raised walls 52. When door is closed, channel 55 is aligned with hole 56 in hinge plate 46 which is a component of bracket 40.

Hinge plate 46 includes an arm 47 which extends away from door 100. Arm 47 is pivotably connected to bracket mount 48 at pivot 49, which may of a pin and channel construction. Bracket mount 48 is fixed to barrier 20 such that barrier 20 may pivot about pivot 49 in relation to hinge plate 46. Hinge plate 46 also includes an upper aperture 57 to receive a tensioning element 43 which may be a spring or any other device which provides tension between hinge plate 46 and barrier 20. Tensioning element 43 is connected to barrier 20 by catch 58. Tensioning element 43, arm 47 and mount 48 keep hinge plate 46 in proper orientation with respect to barrier 20 and door 100 when door is not positioned adjacent barrier 20 (as seen in FIG. 4*a*).

Figure 6:
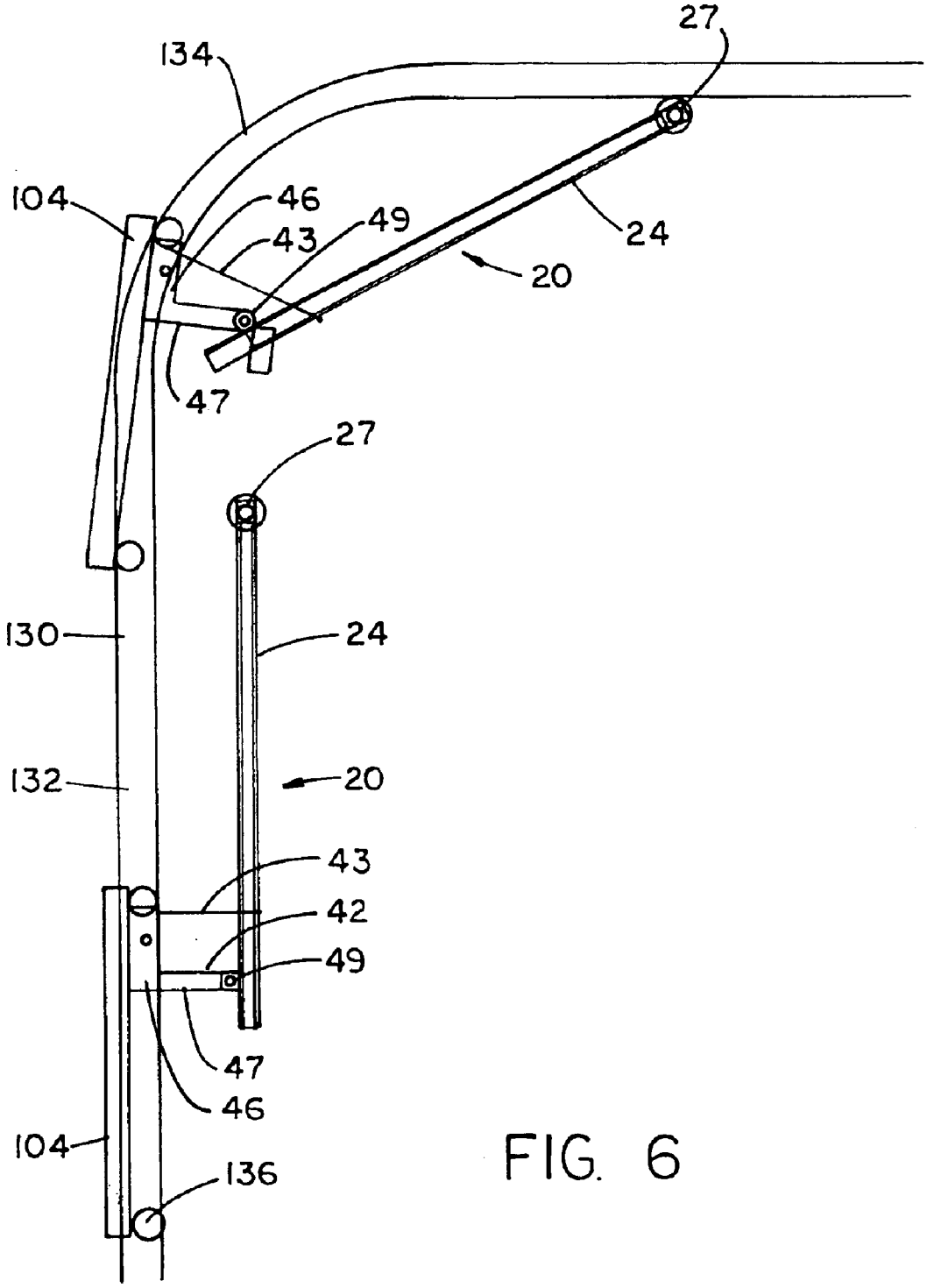
FIG. 6 is a side view of a preferred barrier connected to the door and showing the movement of the barrier as the door is opened and/or closed in accordance with the invention.

FIG. 6 shows barrier 20 at two positions during upward movement with door 100. In the lower position door panel 104 is traveling along a substantially vertical portion 132 of track 130. As door panel moves upward, tensioning elements 43, arms 47 and mounts 48 keep uprights 24 substantially vertical until rollers 27 contact sloping portion 134 of track 130. Then rollers 27 roll along track 130 and tensioning element 43 allows barrier 20 to pivot about pivot 49. When door panel 104 moves downward, tensioning element 43 pulls uprights 24 such that they keep contact with track 130 and barrier 20 pivots back to its original position. In this way, barrier 20 can be moved into and out of the blocking position in which it extends across doorway 102.

During the initial installation of guard assembly 10 on a door 100, barrier 20 is positioned across doorway 102 and coupled to pre-existing posts 120 or posts 120 installed along with the assembly 10. When barrier 20 is properly positioned, door plates may be mounted to the door 100 along a door panel 104 which is at the same height as barrier 20 such that each channel 55 is aligned with each hole 56. Barrier 20 may remain in this blocking position while door 100 is opened or closed. To remove barrier 20 from doorway 104, channels 55 and holes 56 are aligned and pins 45 are passed through each pair of channels and holes to connect barrier 20 to door 100. Then door 100 is opened so that barrier 20 is moved upward solely by the power of the door opening mechanism.

Figure 7:
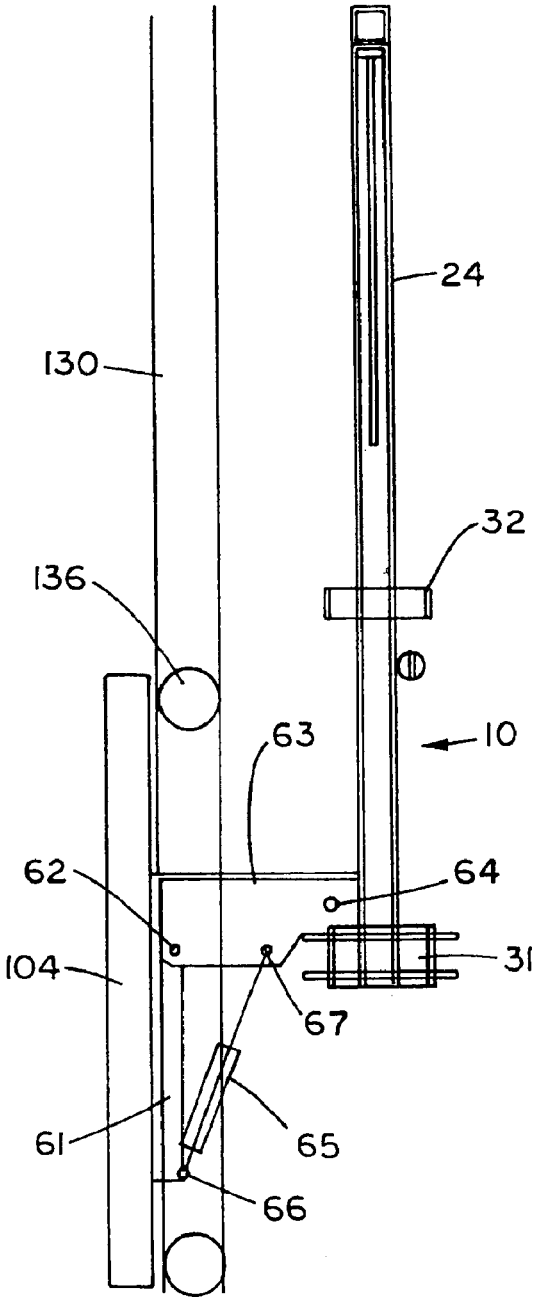
FIG. 7 is a side view of a preferred guard assembly shown connected to a door in accordance with the invention.
Figure 11:
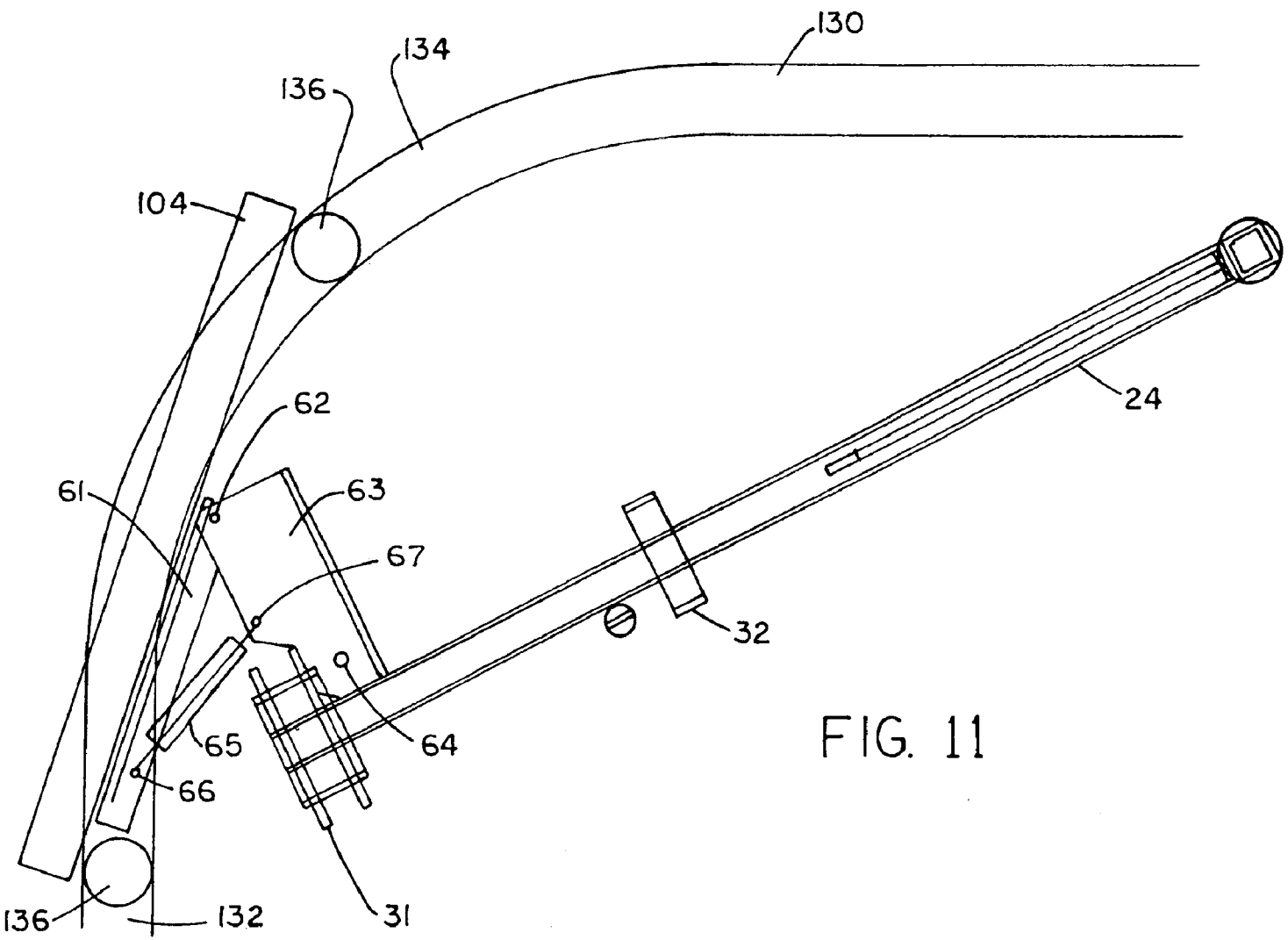
FIG. 11 is a side view of a preferred guard assembly connected to a door and showing the barrier pivoting with respect to the door as the door is opened and/or closed in accordance with the invention.
Figure 12:
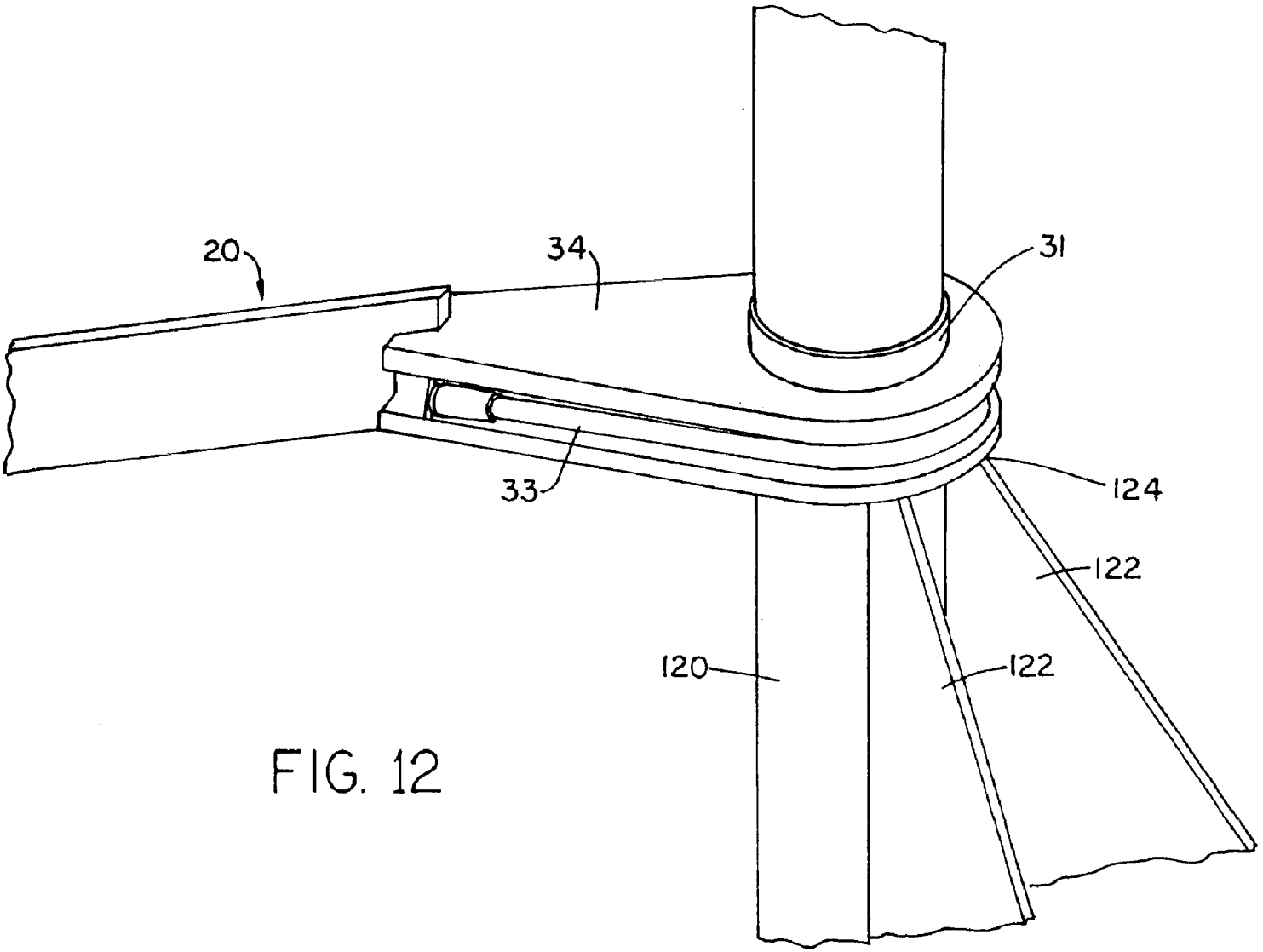
FIG. 12 is an enlarged view of a preferred coupling in accordance with the invention.
Figure 14:
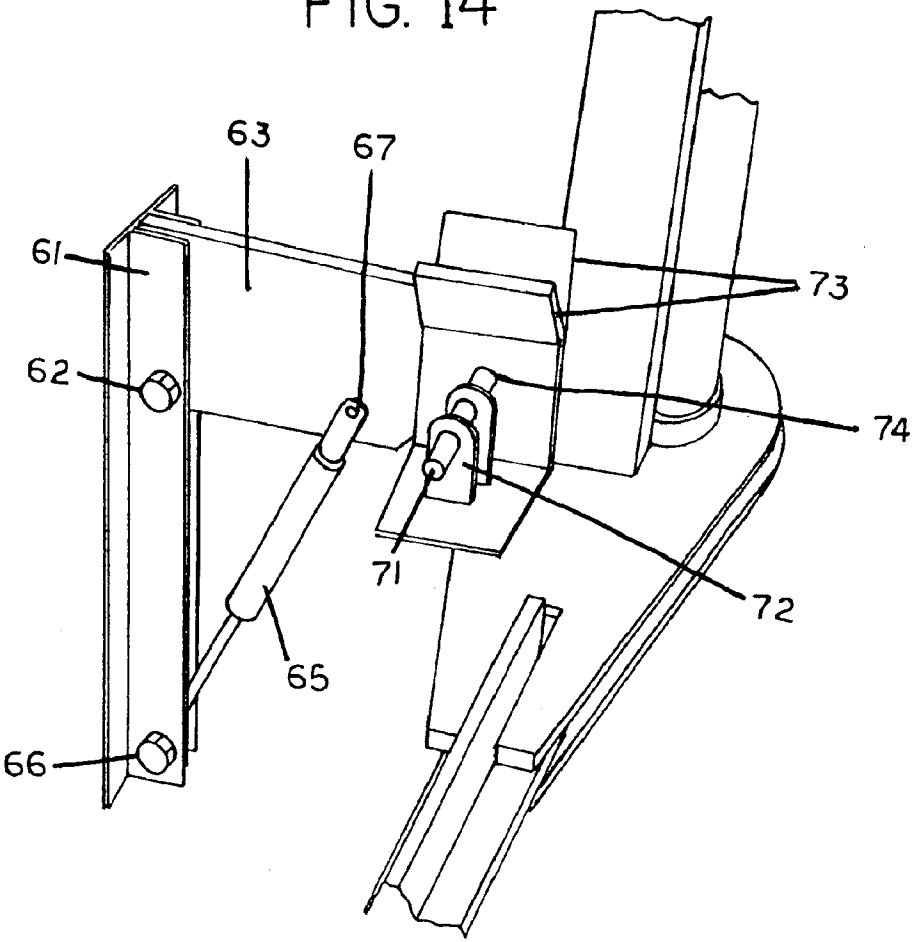
FIG. 14 is perspective view of the preferred coupling of FIG. 13 shown connected to the bracket in accordance with the invention.
Figure 13:
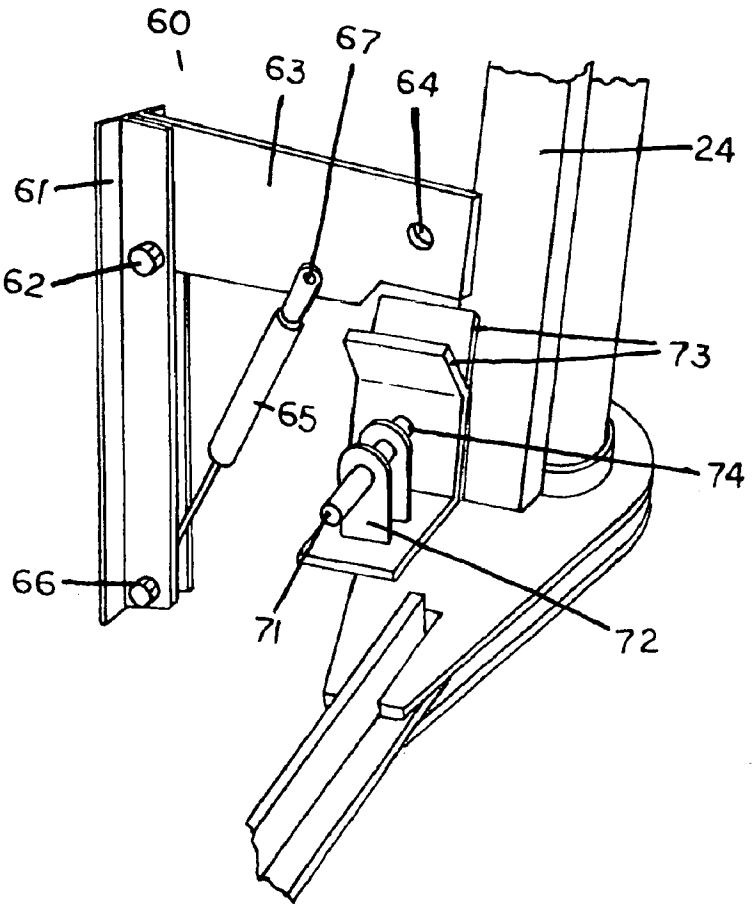
FIG. 13 is perspective view of the preferred coupling of FIG. 12 including connection means for connecting the barrier to the bracket and shown disconnected from the bracket in accordance with the invention.

FIGS. 7–14 show a preferred embodiment of guard assembly 10 in which bracket 60 is mounted to door 100 rather than to barrier 20 as in FIGS. 1–6. As shown in FIG. 7, bracket 60 includes a door plate 61 which is mounted to door 100 by bolts 68 (shown in FIG. 10) and a hinge plate 63 which is pivotably connected to door plate 61 at pivot 62 such that hinge plate 63 may pivot with respect to door 100 and door plate 61. Hinge plate 63 includes a hole 64 which provides for connection to and disconnection from barrier 20 as shown in FIGS. 13 and 14. Hinge plate 63 also includes hinge-plate aperture 67 at which tensioning element 65, preferably a gas spring, is connected. Tensioning element 65 is further connected to door-plate aperture 66 on door plate 61. Tensioning element 65 resists movement of hinge-plate aperture 67 toward door-plate aperture 66 when hinge plate 63 pivots about pivot 62.

Figure 8:
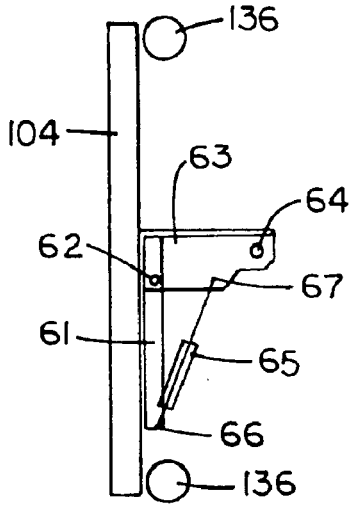
FIG. 8 is a side view of a preferred guard assembly shown disconnected from a door in accordance with the invention.
Figure 9:
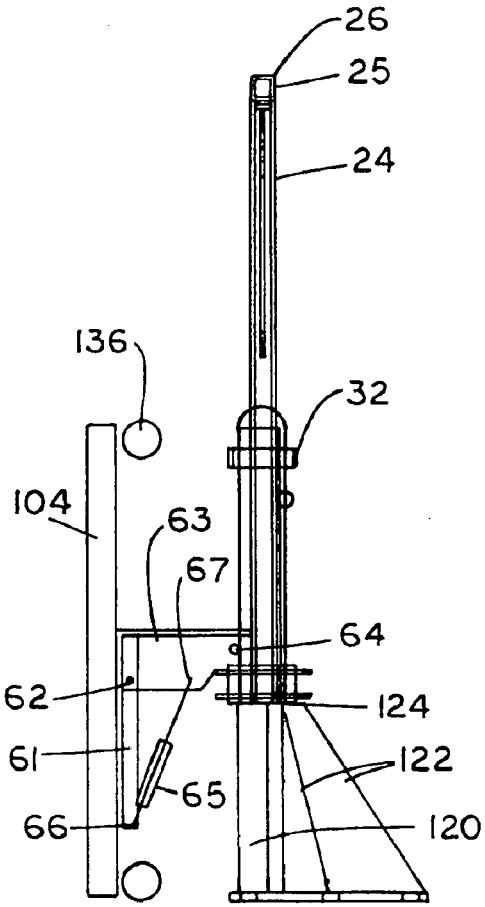
FIG. 9 is a side view of a preferred guard assembly shown connected to a door with the door connected to a post in accordance with the invention.
Figure 10:
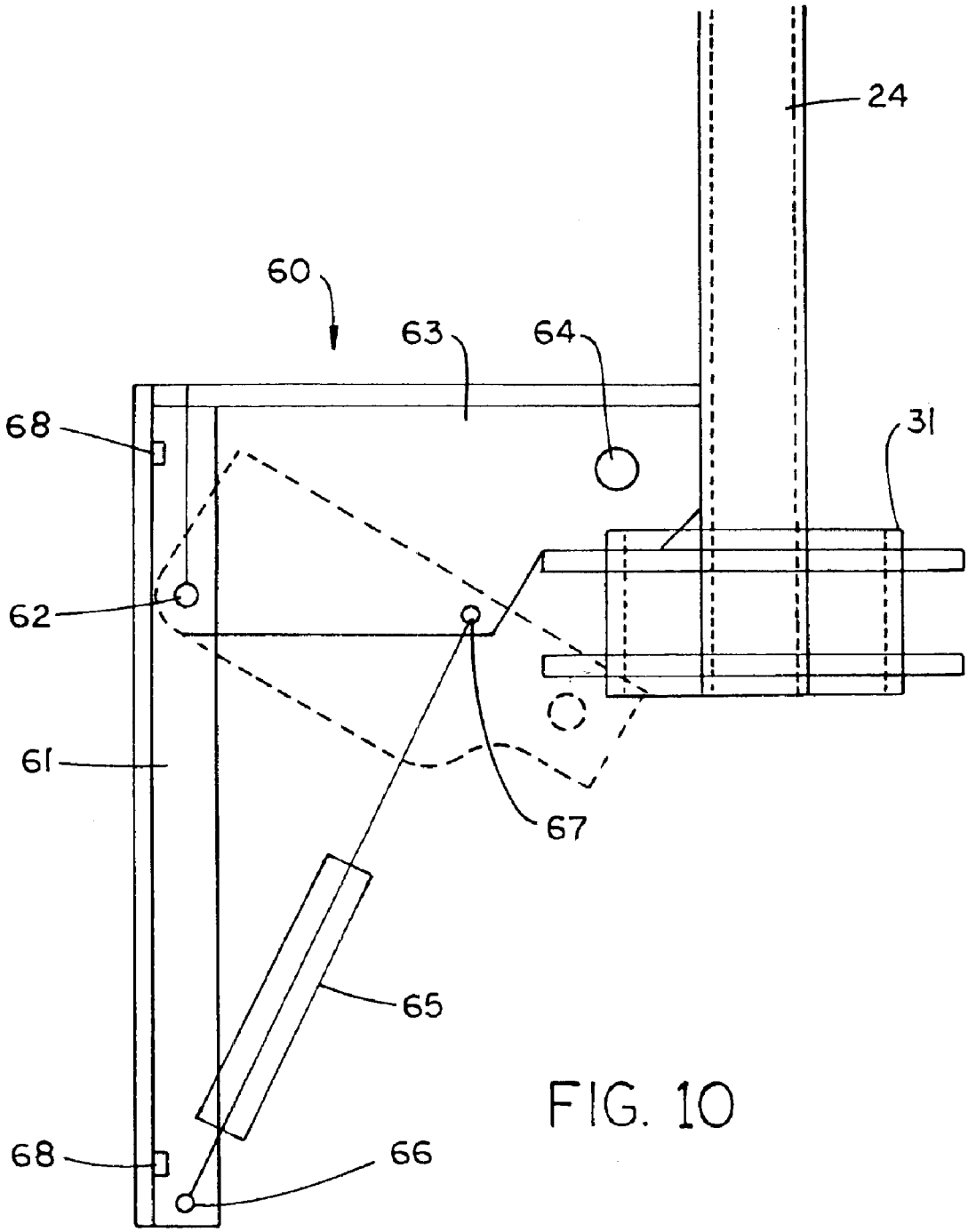
FIG. 10 is an enlarged view of a preferred bracket showing the pivoting motion of the bracket in dashed lines in accordance with the invention.

FIG. 8 shows bracket 60 mounted to door panel 104 while disconnected from barrier 20. As shown, tensioning element 65 keeps hinge plate 63 at a position substantially perpendicular to door plate 61. FIG. 9 shows bracket 60 mounted to door panel 104 and connected to barrier 30 at hole 64. As shown, guard coupling 31 rests on the shoulder 124 formed by trusses 122 when guard coupling 31 receives post 120 and barrier 20 is connected to door 100 by bracket 60. Upper coupling 32 is also shown receiving post 120. FIG. 10 shows bracket 60 after pivoting of hinge plate 63 with respect to door plate 61. As can be seen, tensioning element 65 is compressed by the pivoting of hinge plate 63 toward door plate 61.

FIG. 11 depicts the opening of a door on a track 130 which includes a sloping portion 134 leading to a substantially horizontal portion. As can be seen, barrier 20 has pivoted with respect to door panel 104 to allow uprights 24 to extend substantially horizontally. As door panel 104 moves upward, tensioning elements 65 and hinge plates 63 keep uprights 24 substantially vertical until rollers 27 contact sloping portion 134 of track 130. Then rollers 27 roll along track 130 and tensioning element 65 allows barrier 20 and hinge plate 63 to pivot about pivot 62. When door panel 104 moves downward, tensioning element 65 pushes hinge plate 63 such that uprights 24 keep contact with track 130 and barrier 20 pivots back to its original position. In this way, barrier 20 can be moved into and out of the blocking position in which it extends across doorway 102.

FIG. 12 depicts a preferred barrier 20 which includes a coupling 30 having a cable fitting 34 around which a cable 33 extends. Cable 33 preferably runs along barrier 20 to the opposite coupling 30 and opposite cable fitting 33. Cable 33 provides sufficient tension to prevent anything from breaking through barrier 20 and damaging door 100 or falling off of the dock. In addition, cable 33 is sufficiently light-weight to optimize use of door 100 to remove barrier 20 from the doorway. Cable 33 may include two or more cables to provide increased tension. Cable fitting 33 is preferably aluminum or other similar lightweight metal and includes coupling 31 which receives post 120 and rests on shoulder 124 formed by trusses 122 when barrier 120 is in its blocking position.

FIGS. 13 and 14 depict the connection between bracket 60 and barrier 20. FIG. 13 shows bracket 60 when disconnected from barrier 20. As can be seen hole 64 of hinge plate 63 is positioned above bores 74 of receiving brackets 73 which are mounted to cable fitting 34 and upright 24. Pin 71 is held in pin brace 72 which mounted to cable fitting 73. When the door moves downward, hinge plate 63 is received within the space between brackets 73 until hole 64 is aligned with bores 74, which preferably occurs when the door is closed. Pin 71 is then passed through bores 74 and hole 64, thereby connecting barrier 20 to bracket 60, and thus to the door.

During the initial installation of guard assembly 10 on a door 100, barrier 20 is positioned across doorway 102 and coupled to pre-existing posts 120 or posts 120 installed along with the assembly 10. When barrier 20 is properly positioned, door plates 61 may be mounted to the door 100 along a door panel 104 which is at the same height as barrier 20. Preferably hinge plate 63 is pivotably mounted to door plate 61 before door plate is mounted to door 100. Door plate 61 is preferably positioned such that hole 64 in hinge plate aligns with bore 74 in brackets 73 when door 100 is closed and barrier 20 rests on shoulders 124. Barrier 20 may remain in this blocking position while door 100 is opened or closed. To remove barrier 20 from doorway 104, holes 64 and bores 74 are aligned and pins 71 are passed through brackets 73 and hinge plate 63 to connect barrier 20 to door 100. Then door 100 is opened so that barrier 20 is moved upward solely by the power of the door opening mechanism.

While the invention has been described with respect to specific embodiments by way of illustration, many modifications and changes will occur to those skilled in the art. It is, therefore, to be understood that the appended claims are intended to cover all such modifications and changes as fall within the true scope and spirit of the invention.

What is claimed is:

1. A guard assembly for use near a doorway on a platform, the doorway receiving an overhead door, the platform having at least one post mounted adjacent the doorway, the assembly comprising:

a barrier adapted to extend across the doorway, the barrier having at least one coupling, the coupling adapted to connect to a respective post to allow the barrier to block the doorway, the barrier including (a) a guard rail adapted to extend across the doorway, (b) a pair of uprights extending from the guard rail to distal ends, and (c) a hand rail extending between the distal ends of the uprights; and a bracket adapted to facilitate connection and disconnection between the barrier and the overhead door, the bracket adapted to be fixed to one of the barrier and the door and being adapted to connect with and disconnect from the other of the barrier and the door;

whereby the barrier is adapted to block the doorway whether connected to or disconnected from the door, and the barrier, when connected to the door, is adapted to move with the door as the door opens and closes.

2. The guard assembly of claim 1 wherein the coupling is adapted to be supported by the respective post when connected thereto.

3. The guard assembly of claim 1 wherein the bracket is adapted to connect to and disconnect from the other of the barrier and the door via a pin.

4. The guard assembly of claim 1 wherein the coupling is a sleeve which is adapted to receive the respective post.

5. The guard assembly of claim 1 for use near a doorway on a platform having two posts mounted on opposite sides of the doorway, wherein the barrier has two couplings, each coupling adapted to connect to a respective post.

6. The guard assembly of claim 5 wherein the couplings are guard couplings and further comprising upper couplings, each upper coupling being adapted to connect to a respective post.

7. The guard assembly of claim 1 wherein the bracket includes first and second brackets, each bracket being pivotably connected to the barrier and connected to a respective upright by a tensioning element.

8. The guard assembly of claim 1 wherein the bracket includes first and second brackets, each bracket being adapted to pivotably connect to the door and adapted to further connect to the door by a tensioning element.

9. The guard assembly of claim 1 for use near an overhead door movable along a track, wherein the bracket includes first and second brackets, each bracket being pivotably connected to the barrier and connected to a respective upright by a tensioning element; whereby, the distal ends of the uprights are adapted to contact a sloping portion of the track and cause both the barrier to pivot with respect to the door and the tensioning element to extend, thereby allowing the distal ends of the uprights to move substantially horizontally as the guard rail moves substantially vertically when the door opens.

10. A guard assembly for use near a doorway on a platform, the doorway receiving an overhead door, the platform having at least one post mounted adjacent the doorway, the assembly comprising:

blocking means adapted to extend across the doorway, the blocking means having at least one coupling means, the coupling means adapted to connect to a respective post; and connecting means adapted to facilitate connection and disconnection between the blocking means and the overhead door, the connecting means adapted to be fixed to one of the blocking means and the door and being adapted to connect with and disconnect from the other of the blocking means and the door;

whereby the blocking means is adapted to:

block the doorway when disconnected from the door;

block the doorway when connected to the door while the door is closed; and move with the door when connected to the door as the door opens so that the blocking means does not block the doorway.

11. The guard assembly of claim 10 wherein the blocking means is adapted to move with the door as the door closes and to connect to the post to block the doorway.

12. The guard assembly of claim 10 wherein the connecting means is adapted to be pivotably mounted to the blocking means or the door.

13. The guard assembly of claim 12 wherein the connecting means includes a plate adapted to be mounted with respect to the door, a bracket pivotably mounted with respect to the blocking means, and latching means adapted to connect and disconnect the plate and the bracket.

14. The guard assembly of claim 12 wherein the connecting means includes a plate adapted to be mounted with respect to the door, a bracket pivotably mounted with respect to the plate, and latching means adapted to connect and disconnect the blocking means and the bracket.

15. The guard assembly of claim 10 wherein the connecting means includes a plate adapted to be mounted with respect to the door, a bracket pivotably mounted with respect to the blocking means, and latching means adapted to connect and disconnect the plate and the bracket.

16. A doorway and safety assembly comprising:

a doorway having a track, a door received in the doorway and movable along the track;

a pair of posts mounted on opposite sides of the doorway, a barrier adapted to extend across the doorway, the barrier having two ends with a coupling at each end, each coupling adapted to connect to a respective post; and a bracket adapted to facilitate connection and disconnection between the barrier and the door, the bracket being fixed to one of the barrier and the door and being connected with and disconnected from the other of the barrier and the door, whereby the barrier is adapted to block the doorway whether connected to or disconnected from the door, and the barrier, when connected to the door, is adapted to move with the door as the door opens and closes.

17. The doorway and safety assembly of claim 16 wherein each post has a truss and each truss joins the respective post at a shoulder which supports the couplings.

18. The doorway and safety assembly of claim 17 wherein the couplings are adapted to contact the respective shoulder when the door is closed and the bracket connects the door and barrier.

19. The doorway and safety assembly of claim 16 wherein:

the barrier includes a guard rail extending between the couplings, a pair of uprights extending from the guard rail to a distal end, and a hand rail extending between the distal ends of the uprights;

the bracket includes first and second brackets, each bracket being pivotably connected to one of the barrier and the door; and the overhead door includes pivotably connected panels and moves along a track having substantially vertical and substantially sloping portions;

whereby, after connection between the barrier and the door and during the opening of the door, the distal ends of the uprights are adapted to contact the substantially sloping portion of the track to cause the barrier to pivot with respect to the door and to cause a tensioning element to allow the distal ends of the uprights to move substantially horizontally as the guard rail moves substantially vertically.

20. A guard assembly for use near a doorway on a platform having at least one post mounted adjacent the doorway, the doorway having a track and receiving an overhead door movable on the track, the assembly comprising:

a barrier adapted to extend across the doorway, the barrier having:

a guard rail, at least one coupling connected with respect to the guard rail and adapted to connect to a respective post to allow the guard rail to block the doorway, a pair of uprights extending from the guard rail to a distal end, and a hand rail extending between the distal ends of the uprights; and a bracket adapted to facilitate connection and disconnection between the barrier and the overhead door, the bracket adapted to be fixed to one of the barrier and the door and being adapted to connect with and disconnect from the other of the barrier and the door.

21. A guard assembly for use near a doorway on a platform, the doorway receiving an overhead door, the platform having at least one post mounted adjacent the doorway, the assembly comprising:

blocking means adapted to extend across the doorway, the blocking means having at least one coupling means, the coupling means adapted to connect to a respective post; and connecting means including (a) a plate adapted to be mounted with respect to the door, (b) a bracket pivotably mounted with respect to the blocking means, and (c) latching means adapted to connect and disconnect the plate and the bracket, the connecting means adapted to facilitate connection and disconnection between the blocking means and the overhead door.

22. The guard assembly of claim 21 wherein the blocking means includes a guard rail extending between the coupling means, a pair of uprights extending from the guard rail to distal ends, and a hand rail extending between the distal ends of the uprights.

23. A doorway and safety assembly comprising:

a doorway having a track, an overhead door received in the doorway, the door including pivotably connected panels and being movable along the track;

a pair of posts mounted on opposite sides of the doorway, a barrier adapted to extend across the doorway, the barrier having two ends with a coupling at each end, each coupling adapted to connect to a respective post, the barrier including a guard rail extending between the couplings, a pair of uprights extending from the guard rail to a distal end, and a hand rail extending between the distal ends of the uprights; and a bracket adapted to facilitate connection and disconnection between the barrier and the overhead door, the bracket including first and second brackets, each bracket being pivotably connected to one of the barrier and the door and being connected with and disconnected from the other of the barrier and the door.

* * * * *